US007530675B2

(12) United States Patent
Domoto et al.

(10) Patent No.: US 7,530,675 B2
(45) Date of Patent: May 12, 2009

(54) PIEZOELECTRIC ACTUATOR DEVICE

(75) Inventors: Gerald A. Domoto, Briarcliff Manor, NY (US); Elias Panides, Whitestone, NY (US); S. Warren Lohr, Sleepy Hollow, NY (US); Terrance L. Stephens, Molalla, OR (US); Nicholas P. Kladias, Flushing, NY (US)

(73) Assignee: Xerox Corporation, Norwalk, CT (US)

( * ) Notice: Subject to any disclaimer, the term of this patent is extended or adjusted under 35 U.S.C. 154(b) by 496 days.

(21) Appl. No.: 11/489,532

(22) Filed: Jul. 20, 2006

(65) Prior Publication Data

US 2008/0018714 A1 Jan. 24, 2008

(51) Int. Cl.
*B41J 2/045* (2006.01)

(52) U.S. Cl. ..... 347/70

(58) Field of Classification Search ..... 347/70, 347/71–72, 68–69; 400/124.16; 310/311; 29/25.35, 890.1

See application file for complete search history.

(56) References Cited

U.S. PATENT DOCUMENTS

| | | | | |
|---|---|---|---|---|
| 4,599,628 | A * | 7/1986 | Doring et al. | 347/71 |
| 2002/0186278 | A1 | 12/2002 | Nakamura et al. | |
| 2002/0196314 | A1 | 12/2002 | Greiser et al. | |
| 2004/0113521 | A1 | 6/2004 | Buhler et al. | |
| 2004/0130243 | A1 | 7/2004 | Buhler et al. | |
| 2007/0139481 | A1 * | 6/2007 | Xu et al. | 347/64 |

* cited by examiner

*Primary Examiner*—K. Feggins
(74) *Attorney, Agent, or Firm*—MH2 Technology Law Group LLP

(57) ABSTRACT

The present application is directed to piezoelectric actuator devices. One embodiment of a piezoelectric actuator comprises a chamber diaphragm having a major surface. A piezoelectric transducer is positioned on the major surface of the chamber diaphragm. The piezoelectric transducer has a major surface having a first dimension which is smaller than a corresponding second dimension of the major surface of the chamber diaphragm, so that the piezoelectric transducer underlaps the chamber diaphragm. The underlap ratio of the first dimension to the second dimension ranges from about 0.70 to about 0.99.

18 Claims, 6 Drawing Sheets

FIG. 1A
RELATED ART
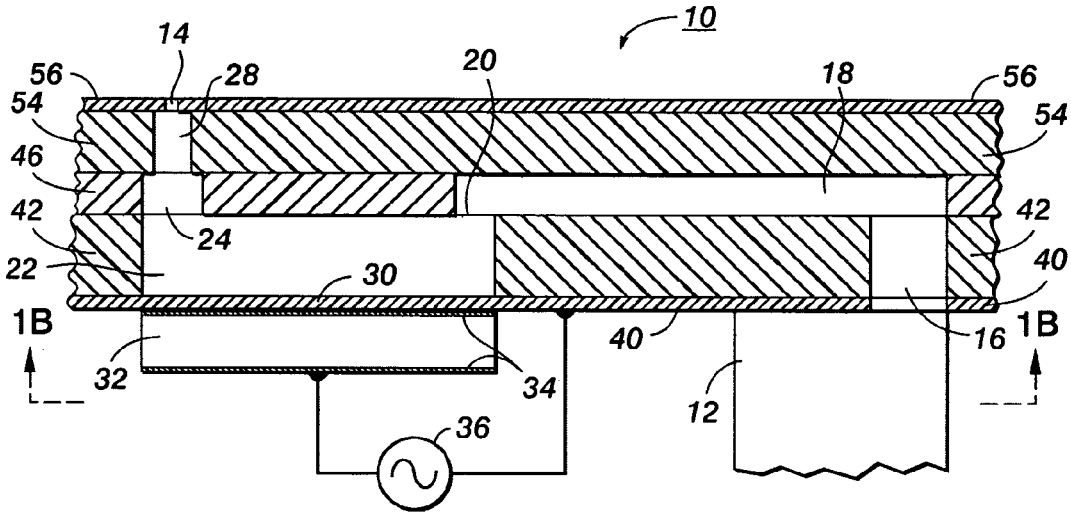
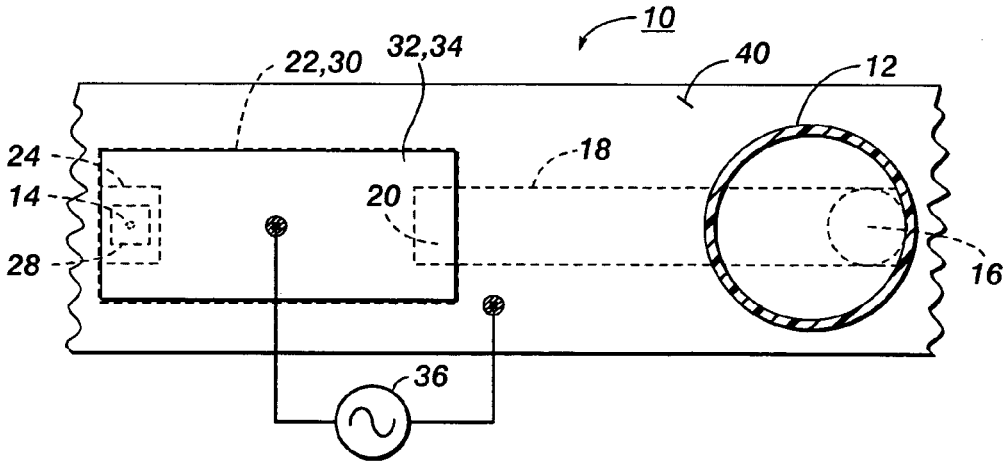
FIG. 1B
RELATED ART

FIG. 2A
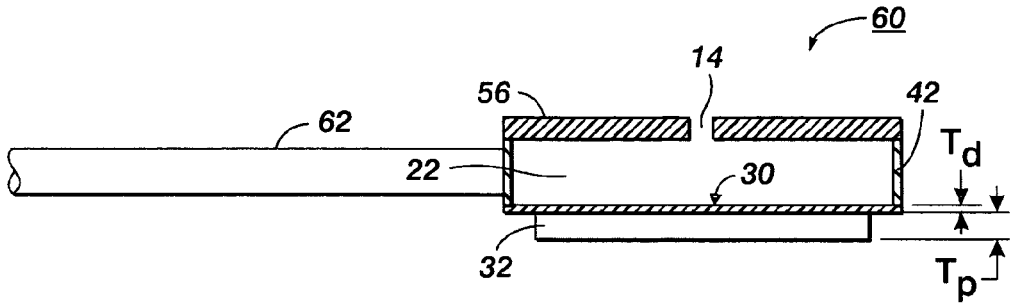
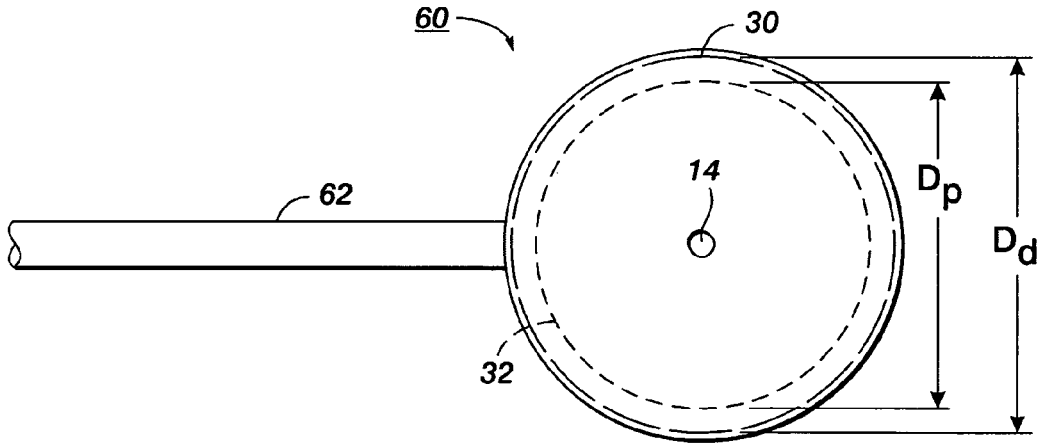
FIG. 2B

FIG. 4
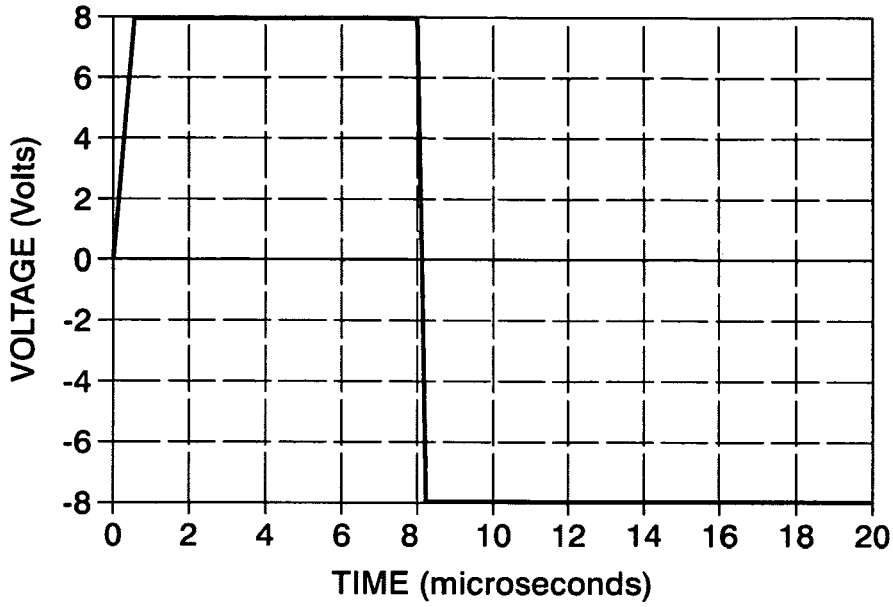
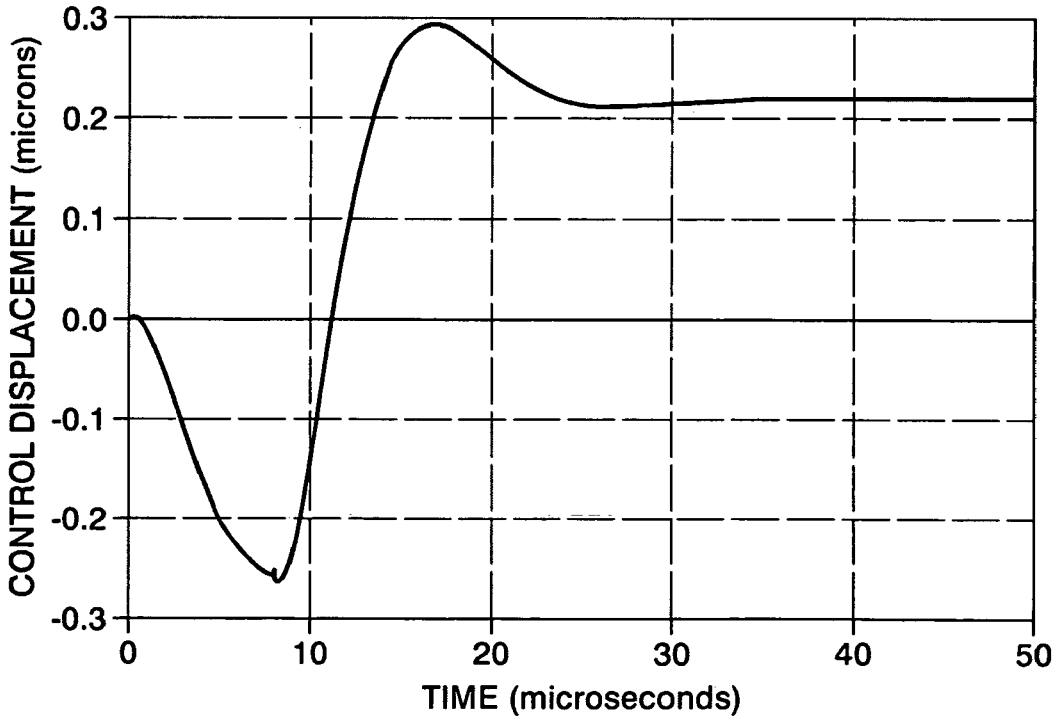
FIG. 5

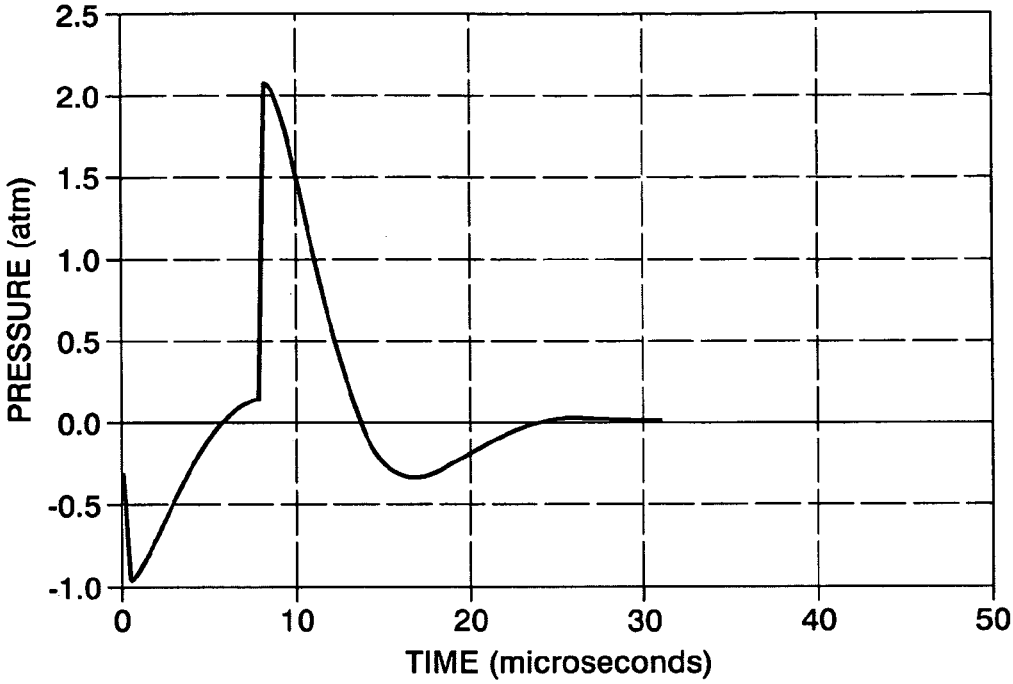
FIG. 6
FIG. 7
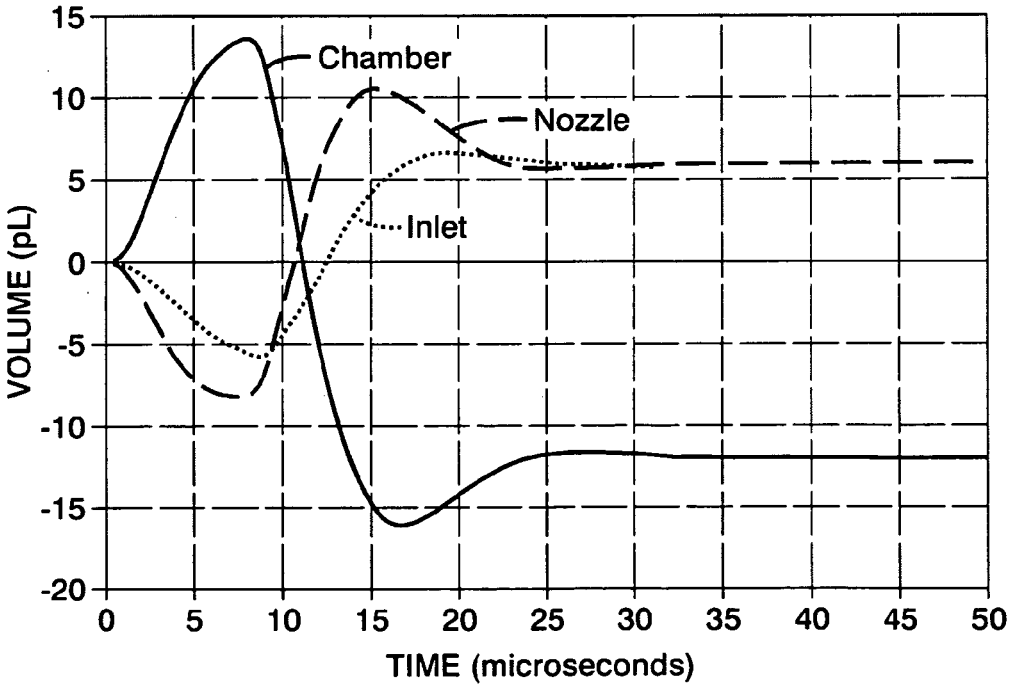

FIG. 8
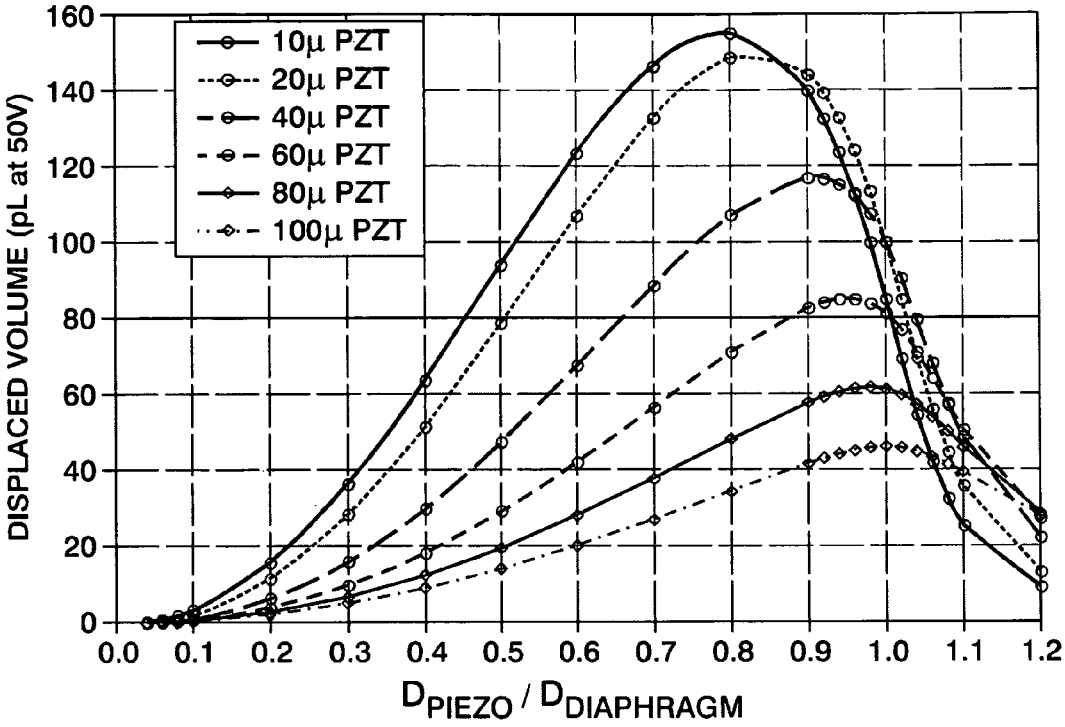
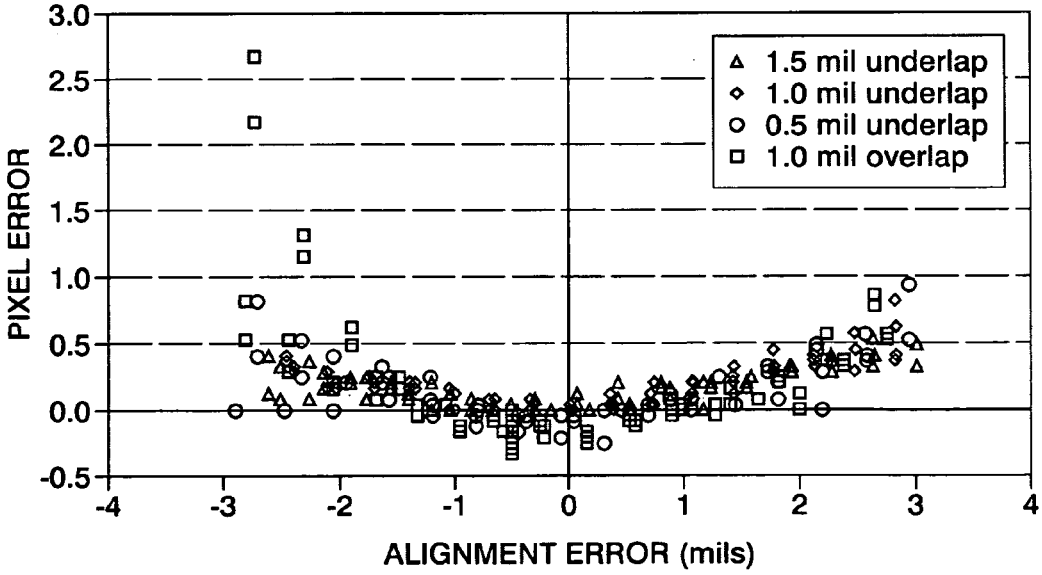
FIG. 9

PIEZOELECTRIC ACTUATOR DEVICE

FIELD OF THE DISCLOSURE

The present application is directed to a piezoelectric actuator, and more particularly to a piezoelectric actuator having an underlapped piezoelectric layer.

BACKGROUND OF THE DISCLOSURE

Piezoelectric actuators have many applications. In particular, piezoelectric diaphragms have been employed as pressure sensors, in speakers for audio equipment, and fluid ejection, fluid pumping, and printing applications. One specific application for piezoelectric actuators is as jetting drivers in ink jet print heads.

FIGS. 1A and 1B illustrate one example of a single ink jet 10 that is suitable for use in an ink jet array print head. The ink jet 10 has a body that defines an ink manifold 12 through which ink is delivered to the ink jet print head. The body also defines an ink drop-forming orifice, or nozzle, 14 together with an ink flow path from ink manifold 12 to nozzle 14. In general, the ink jet print head preferably includes an array of closely spaced nozzles 14 for use in ejecting drops of ink onto an image-receiving medium (not shown), such as a sheet of paper or a transfer drum. Ink jet print heads can have a plurality of manifolds for receiving various colors of ink.

Ink flows from manifold 12 through an inlet port 16, an inlet channel 18, a pressure chamber port 20, and into an ink pressure chamber 22. Ink leaves pressure chamber 22 by way of an outlet port 24 and flows through an outlet channel 28 to nozzle 14, from which ink drops are ejected.

Ink pressure chamber 22 is bounded on one side by a flexible diaphragm 30. A piezoelectric transducer 32 is secured to diaphragm 30 by any suitable technique and overlays ink pressure chamber 22. Metal film layers 34, to which an electronic transducer driver 36 can be electrically connected, can be positioned on either side of piezoelectric transducer 32.

Piezoelectric transducer 32 is operated in its bending mode such that when a voltage is applied across metal film layers 34, transducer 32 attempts to change its dimensions. However, because it is secured rigidly to the diaphragm 30, piezoelectric transducer 32 bends, deforming diaphragm 30, thereby displacing ink in ink pressure chamber 22, causing the outward flow of ink through outlet port 24 and outlet channel 28 to nozzle 14. Refill of ink pressure chamber 22 following the ejection of an ink drop is augmented by reverse bending of piezoelectric transducer 32 and the concomitant movement of diaphragm 30, which draws ink from manifold 12 into pressure chamber 22.

To facilitate manufacture of an ink jet array print head, ink jet 10 can be formed of multiple laminated plates or sheets. These sheets are stacked in a superimposed relationship. Referring once again to FIGS. 1A and 1B, these sheets or plates include a diaphragm plate 40, which forms diaphragm 30 and a portion of manifold 12; an ink pressure chamber plate 42, which defines ink pressure chamber 22 and a portion of manifold 12; an inlet channel plate 46, which defines inlet channel 18 and outlet port 24; an outlet plate 54, which defines outlet channel 28; and an orifice plate 56, which defines-nozzle 14 of ink jet 10. The piezoelectric-transducer 32 is bonded to diaphragm 30, which is a region of diaphragm plate 40 covering ink pressure chamber 22.

The jet driver design plays a major role in determining the performance characteristics of the inkjet printhead. For example, jet efficiency depends upon, among other things, the dimensions of the piezoelectric transducer in relation to the diaphragm. In order to achieve jetting device packing densities required by high resolution printing, more efficient actuator designs that can increase the volumetric displacement of the ink chamber for a given driver voltage are desired.

Also, performance variation of inkjet devices caused by piezoelectric transducer alignment error within a monolithic printhead is a recognized problem in the manufacture of inkjet printheads. For example, the required jetting voltage of individual inkjets can vary to an unacceptable degree with the misalignment of the piezoelectric transducer relative to the diaphragm. This sensitivity of the jetting voltage to misalignment of the piezoelectric transducer is undesirable, and requires tight manufacturing tolerances. Therefore, improved inkjet printhead designs with reduced sensitivity are desired.

SUMMARY OF THE DISCLOSURE

An embodiment of the present application is directed to a piezoelectric actuator. The piezoelectric actuator comprises a chamber diaphragm having a major surface, and a piezoelectric transducer positioned on the major surface of the chamber diaphragm. The piezoelectric transducer has a major surface having a first dimension which is smaller than a corresponding second dimension of the major surface of the chamber diaphragm, so that the piezoelectric transducer underlaps the chamber diaphragm. The underlap ratio of the first dimension to the second dimension ranges from about 0.70 to about 0.99.

Another embodiment of the present application is directed to an inkjet printhead. The inkjet printhead comprises an ink chamber defining a chamber aperture; a chamber diaphragm having a first major surface overlaying the chamber aperture; and a piezoelectric transducer positioned on the major surface of the chamber diaphragm. The piezoelectric transducer has a major surface having a first dimension which is smaller than a corresponding second dimension of the major surface of the chamber diaphragm, so that the piezoelectric transducer underlaps the chamber diaphragm. The underlap ratio of the first dimension to the second dimension ranges from about 0.70 to about 0.99.

Additional embodiments and advantages of the disclosure will be set forth in part in the description which follows. The advantages of the disclosure will be realized and attained by means of the transducers and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate several embodiments of the disclosure and, together with the description, serve to explain the principles of the disclosure.

BRIEF DESCRIPTION OF THE DRAWINGS

FIGS. 1A and 1B illustrate a related art example of an ink jet that is suitable for use in an ink jet array print head.

FIGS. 2A and 2B illustrate cross-sectional and top views, respectively, of an inkjet, according to an embodiment of the present application.

FIG. 4 shows a simple bi-polar waveform used in modeling performance characteristics of an inkjet in an example of the present application.

FIG. 5 shows predicted results for displacement of an inkjet actuator verses time for a modeled inkjet in an example of the present application.

FIG. 6 shows chamber pressure verses time results for a modeled inkjet in an example of the present application.

FIG. 7 shows ink volume change verses time results for a modeled inkjet in an example of the present application.

FIG. 8 shows modeled results predicting a relationship between the thickness of a piezoelectric actuator, and the desired ratio of the diameter of the piezoelectric actuator to the diameter of the diaphragm of the inkjet for achieving a maximum ink volume displacement.

FIG. 9 illustrates an example of pixel error due to mechanical cross talk between neighboring inkjets versus alignment error.

DESCRIPTION OF THE EMBODIMENTS

Figure 3A:
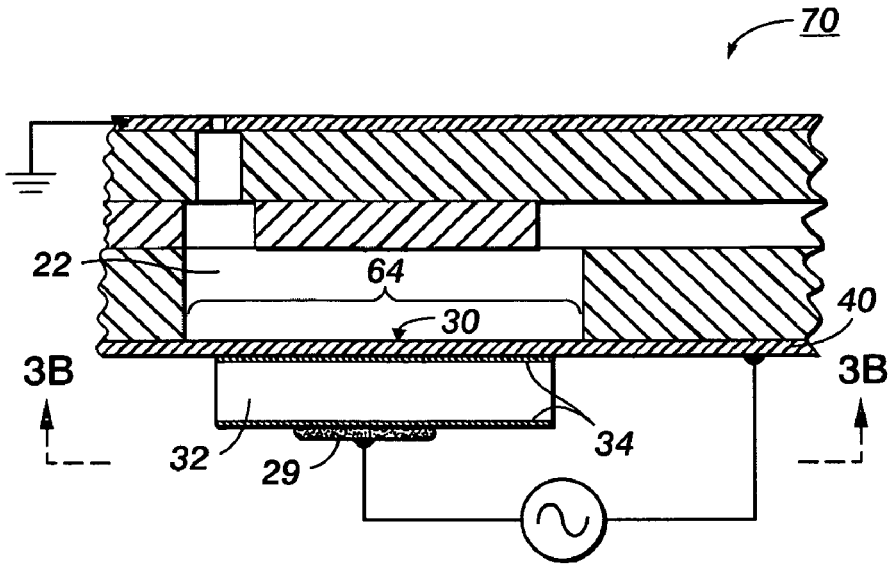
FIGS. 3A and 3B illustrate cross-sectional and top views, respectively, of a single ink jet with a rectangular shaped diaphragm and piezoelectric transducer, according to an embodiment of the present application.

Reference will now be made in detail to various exemplary embodiments of the present application, examples of which are illustrated in the accompanying drawings. Wherever possible, the same reference numbers will be used throughout the drawings to refer to the same or like parts.

FIG. 2A illustrates a simplified, cross-sectional view of an inkjet 60, according to an embodiment of the present application. Inkjet 60 includes an inlet channel 62, an ink chamber 22, and a nozzle 14 formed in an orifice plate 56. Ink chamber 22 is bounded on at least one side by a diaphragm 30. A piezoelectric transducer 32 is positioned on a major surface of diaphragm 30. In the present application, the term "on" is defined so as not to require direct contact between piezoelectric transducer 32 and diaphragm 30. For example, in some embodiments, one or more metal layers can be formed between piezoelectric transducer 32 and diaphragm 30.

A top view of the FIG. 2A embodiment is shown in FIG. 2B. As shown in FIG. 2A, piezoelectric transducer 32 has a first dimension, $D_p$, which underlies a corresponding second dimension, $D_d$, of diaphragm 30. Dimension, $D_p$, of piezoelectric transducer 32 is smaller than dimension, $D_d$, of diaphragm 30, resulting in an underlapped arrangement of piezoelectric transducer 32 relative to diaphragm 30.

The degree of underlap of the piezoelectric transducer 32 relative to diaphragm 30 may be expressed in terms of an underlap ratio, which in this case is the ratio of diameter $D_p$ to diameter $D_d$. In some embodiments, the ratio of $D_p$ to $D_d$ may range from about 0.7 to about 0.99, and any ratio there between. In one embodiment, the $D_p$:$D_d$ ratio ranges from about 0.8 to about 0.9. In yet another embodiment, the $D_p$:$D_d$ ratio is about 0.85.

Underlapped piezoelectric actuator designs, such as that shown in the embodiment of FIG. 2, can improve inkjet performance. For example, in the FIG. 2 embodiment, where the diameter of piezoelectric transducer 32 is smaller than a corresponding diameter of diaphragm 30, the device may have increased jet efficiency, reduced mechanical cross talk, and/or a decreased sensitivity of the jetting voltage to misalignment of the piezoelectric transducer.

Jetting efficiency, as discussed herein, is defined as:

$$\text{Jet Efficiency} = \frac{\text{Volumetric Displacement}}{\text{Drive Voltage}}$$

Volumetric displacement refers to the displaced volume of ink in the ink chamber, and drive voltage is the voltage applied to the jet driver. Thus, increasing jet efficiency lowers the required drive voltage necessary to achieve the same volumetric displacement of ink from the ink chamber. Reduced drive voltages are becoming more important as ink jet device densities continue to increase.

Reducing the dimensions of piezoelectric transducer 32 may also mitigate mechanical cross talk between adjacent actuators. Mechanical crosstalk results from the expansion and contraction of piezoelectric transducer 32, which can cause mechanical stresses across the print head that interfere with the functioning of adjacent devices.

Piezoelectric actuators having an underlapped design, such as the devices of the present application, can result in reduced mechanical crosstalk. For example, FIG. 9 illustrates pixel error due to mechanical cross talk between neighboring inkjets versus alignment error. Data for inkjets having differing degrees of overlap or underlap of the piezoelectric transducer are shown. As seen in FIG. 9, where there is alignment error in the device having +1 mil overlap (indicating for this example that a piezoelectric transducer overlaps the diaphragm by approximately 1 mil around its perimeter), pixel error due to cross talk can dramatically increase. However, in the devices having 0.5 mil, 1 mil and 1.5 mils of underlap (underlap values for this example assume perfect alignment), the pixel error data flattens out, indicating a decrease in pixel error due to cross talk for cases where misalignment occurs.

Figure 3B:
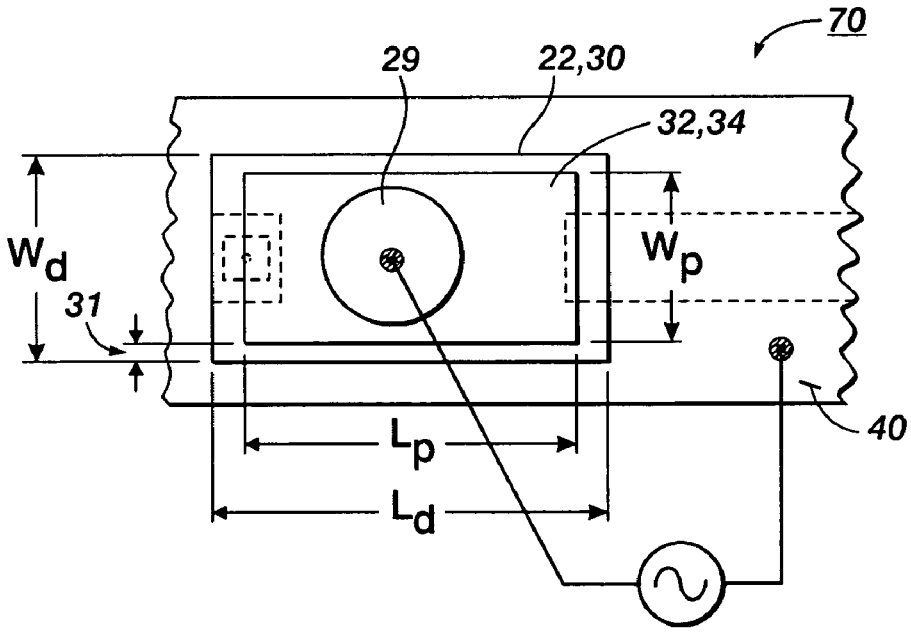

The data in FIG. 9 is for devices having a rectangular shaped diaphragm and piezoelectric transducer, similar to the actuators shown in the devices of FIGS. 3A and 3B. The device having 1.5 mils of underlap in FIG. 9 corresponds to a device having a $W_p$:$W_d$ ratio of about 0.89 and a $L_p$:$L_d$ ratio of about 0.94; the 1.0 mil of underlap corresponds to a device having an $W_p$: $W_d$ ratio of about 0.93 and a $L_p$:$L_d$ ratio of about 0.96; and the 0.5 mils of underlap corresponds to a device having an $W_p$:$W_d$ ratio of about 0.96 and a $L_p$:$L_d$ ratio of about 0.98.

Underlapped inkjet designs can also result in decreased sensitivity of the jetting voltage to misalignment of the piezoelectric transducer. In several solid inkjet designs, a relationship between piezoelectric misalignment and jetting voltage has been observed. For example, in some instances, the jetting voltage has been observed to increase by nearly 1.8 volts for every 1 mil that a piezoelectric transducer is misaligned relative to the diaphragm. This jetting voltage sensitivity to piezoelectric misalignment can result in undesirable variations in the jetting voltages employed to achieve consistent ink drop volumes between inkjet heads. In addition, if alignment varies greatly within a single head, the drive voltage needed by individual jets within the head will also vary greatly. Thus, piezoelectric misalignment can cause undesirable variations in jetting velocity and/or drop mass within the head.

Underlapping the piezoelectric transducer relative to the diaphragm can effectively reduce the sensitivity of the jetting voltage to misalignment of the piezoelectric transducer, and thereby mitigate the undesirable effects discussed above. Table 1, below, illustrates this effect. As shown in Table 1, as underlap increases, the voltage range, which is the difference between drive voltages for devices with perfect alignment and drive voltages for devices with 3 mils of misalignment, can significantly decrease. In devices having 1.5 mils of underlap, a voltage range of only 2.1 V occurs, which is significantly less than the voltage range of 5.3 V for devices having 1 mil of overlap.

The data in Table 1 is for devices having a rectangular shaped diaphragm and piezoelectric transducer, similar to the actuators shown in the devices of FIGS. 3A and 3B. The 1.5 mils of underlap in Table 1 corresponds to a device having an $W_p$:$W_d$ ratio of about 0.89 and a $L_p$:$L_d$ ratio of about 0.94. The 1.0 mil of underlap corresponds to a device having an $W_p$:$W_d$ ratio of about 0.93 and a $L_p$:$L_d$ ratio of about 0.96. The 0.5 mils of underlap corresponds to a device having an $W_p$:$W_d$ ratio of about 0.96 and a $L_p$:$L_d$ ratio of about 0.98.

TABLE 1

| PZT UNDERLAP | VOLTAGE WITH PERFECT ALIGNMENT | VOLTAGE WITH 3 MILS MISALIGNMENT | VOLTAGE RANGE |
|---|---|---|---|
| 1 MIL OVERLAP | 29.9 V | 35.2 V | 5.3 V |
| 0.5 MIL UNDERLAP | 31.6 V | 34.9 V | 3.3 V |
| 1.0 MIL UNDERLAP | 32.1 V | 34.9 V | 2.8 V |
| 1.5 MIL UNDERAP | 32.7 V | 34.8 V | 2.1 V |

Referring again to FIGS. 2A and 2B, the diameters of diaphragm 30 and piezoelectric transducer 32 can be any suitable dimensions which allow for the desired $D_p$:$D_d$ ratio. For example, $D_d$ can range from about 50 microns to about 1000 microns, and any width there between; and $D_p$ can range from about 40 to about 850 microns, and any width there between. In one example, $D_d$ is chosen to be about 400 microns, and $D_p$ is chosen to be about 340 microns. Widths outside of the above ranges for $D_d$ and $D_p$ can also be chosen. Thus, $D_d$ can be less than 50 microns and greater than 1000 microns, and $D_p$ can be less than 40 microns and greater than 850 microns.

The thickness of the piezoelectric transducer 32 can affect the desired width ratio of diaphragm 30 and piezoelectric transducer 32. This relationship is illustrated in FIG. 8, which shows the predicted volume displaced in an inkjet chamber due to actuation of a piezoelectric actuator, verses the $D_{PIEZO}$ to $D_{DIAPHRAGM}$ ratio, where $D_{PIEZO}$ is the diameter of a PZT piezoelectric transducer and $D_{DIAPHRAGM}$ is the diameter of the diaphragm of the actuator. Data for varying piezoelectric thicknesses is shown. As illustrated in FIG. 8, it is generally the case that the ratio $D_p$:$D_d$ that will provide the optimal jet efficiency decreases as the thickness of the piezoelectric transducer decreases. FIG. 8 does not take into account the effect of ink load in the ink chamber, or the fluid path of the ink, which can also affect the optimal ratio of $D_p$:$D_d$.

The thickness of diaphragm 30 can be any suitable thickness. In one embodiment, the thickness, $T_d$, of diaphragm 30 ranges from about 1 micron to about 100 microns. In another embodiment, $T_d$ ranges from about 4 microns to about 8 microns. For example, $T_d$ can be about 6 microns.

The thickness of piezoelectric transducer 32 can be any suitable thickness. In one embodiment, the thickness, $T_p$, of piezoelectric transducer 32 ranges from about 1 micron to about 100 microns. In another embodiment, $T_p$ ranges from about 6 microns to about 10 microns. For example, $T_p$ can be about 8 microns.

Diaphragm 30 can be made out of any suitable material having adequate stiffness, strength and manufacturability. Examples of suitable materials include single crystal silicon, polysilicon, silicon nitride, silicon dioxide, stainless steel, aluminum, polyimide, nickel, glass, and epoxy resins.

Piezoelectric transducer 32 can be made of any ferroelectric or electrostrictive material, or any other material which changes physical dimension as the electric field in the material is changed. Examples of suitable materials include ceramics, such as lead-zirconium-titanate (PZT), lead-titanate ($PbTiO_2$), barium-titanate ($BaTiO_3$), lead-magnesium-niobium-titanate; or crystalline materials, such as zinc-oxide (ZnO), aluminum-nitride (AlN), quartz, lithium-tantalate ($LiTaO_3$) and lithium-niobate ($LiNbO_2$). Any suitable forms of these materials may be used, such as polycrystalline forms or single crystal forms. Other examples of suitable materials include polymeric materials such as polyvinylidene fluoride (PVDF) and its co-polymers. Piezoelectric transducer 32 can be deposited by any suitable method, such as screen printing or sol-gel techniques, both of which are well known in the art.

As mentioned above, FIGS. 2A and 2B are simplified schematic drawings that show only the elements of the inkjet device 10 that are useful for describing the concepts of the present application. One of ordinary skill in the art would readily understand that the concepts of the present application would apply to a variety of inkjet devices of differing designs, sizes, and shapes. For example, while the diaphragm 30 and piezoelectric transducer 32 of the embodiment of FIG. 2 have circular shaped cross-sections, the concepts of the present application can readily apply to inkjet devices having diaphragms and piezoelectric transducers with cross-sections of various other shapes, such as, square, rectangular and rhomboidal shaped cross-sections. In some embodiments, the diaphragms may have a different shape than the piezoelectric transducer. For example, diaphragm 30 may have a rectangular shaped cross-section and the piezoelectric transducer 32 may have a circular shaped cross-section.

FIGS. 3A and 3B illustrate one embodiment of a single ink jet 70 with a rectangular shaped diaphragm 30 and piezoelectric transducer 32. As in the ink jet 60 of the FIG. 2 embodiment, a diaphragm 30 overlays ink chamber 22. A piezoelectric transducer 32 is positioned on a major surface of diaphragm 30. In this embodiment, metal film layers 34 can be positioned on either side of piezoelectric transducer 32.

In accordance with the present application, the piezoelectric transducer 32 of the FIG. 3 embodiment underlaps the diaphragm 30. For purposes of the present application, the diaphragm 30 is the portion of plate 40 that is bounded on one side by aperture 64 of the ink chamber 22. Thus the width and length dimensions of diaphragm 30 are the same as the corresponding width and length dimensions of aperture 64.

In this embodiment, width, $W_p$, of the piezoelectric transducer 32 is shorter than width, $W_d$, of diaphragm 30, resulting in an underlap 31. Similarly, length, $L_p$, of the piezoelectric transducer 32 is shorter than length, $L_d$, of diaphragm 30. The underlap ratios of $W_p$ to $W_d$ and $L_p$ to $L_d$ may range from about 0.70 to about 0.99, and any ratio there between. In one embodiment, underlap ratios $W_p$:$W_d$ and $L_p$:$L_d$ both range from about 0.80 to about 0.90. In yet another embodiment, underlap ratios $W_p$: $W_d$ and $L_p$:$L_d$ are both about 0.85. The underlap ratios $W_p$: $W_d$ and $L_p$:$L_d$ can be the same or different.

Piezoelectric transducer 32 and diaphragm 30 need not have the same shape. For example, the major surface of diaphragm 30 on which piezoelectric transducer 32 is formed can be a rectangle, or other polygon, while the major surface of piezoelectric transducer adjacent the diaphragm 30 can have a circular or oval shape, and vice-versa.

EXAMPLE 1

Modeling of a device having the design shown in FIGS. 2A and 2B was performed to determine optimized design parameters. The modeled design was based on a design having the following specifications and dimensions: a silicon diaphragm 30 with a thickness of 6 microns and a diameter of 400 microns; a PZT piezoelectric transducer 32 having a thickness of 8 microns and a diameter of 340 microns; an inlet channel 62 having a rectangular shape, with a length of 480 microns, a width of 47 microns and a height of 47 microns; a cylindrical ink chamber 22, having a diameter of 400 microns and a height of 47 microns; and a nozzle 14 having a diameter of 23.9 microns and a length of 25 microns (the length of the nozzle corresponding to the thickness of the orifice plate 56). The relative size of the diaphragm and piezoelectric transducer in this modeled example correspond to a $D_p$:$D_d$ ratio of 0.85.

Modeling results of the performance characteristics of the device of Example 1 are obtained by applying a simple bi-polar waveform to the model. FIG. 4 shows such a simple bi-polar waveform, with an amplitude of 8 V that is used in the model. The modeled electric field across the PZT piezoelectric transducer using this waveform is 1 V/micron.

The results of modeling the performance characteristics for this example are shown in FIGS. 5 to 7. The initial positive pulse (for the first 8 microseconds) causes the downward motion of the actuator, which increases the volume of the ink chamber. The resulting negative pressure draws ink form the reservoir. At 8 microseconds, the polarity of the waveform switches to cause a sudden reversal in the motion of the actuator, as shown in FIG. 5. This generates a positive pressure pulse, shown in FIG. 6. The positive pressure pulse is sufficient to cause ink in the chamber to flow out of the nozzle in the form of a drop. As shown in FIG. 7, the predicted maximum nozzle volume change for this example is about 10 pL, although the actual drop size is smaller than this, such as about 8.5 pL. The peak speed of the ink drop in this example is predicted to be about 5.2 meters per second.

This example shows that an underlapped actuator can be the basis for a small but efficient single jet design to support large nozzle packing densities with low voltage operation.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an acid" includes two or more different acids. As used herein, the term "include" and its grammatical variants are intended to be non-limiting, such that recitation of items in a list is not to the exclusion of other like items that can be substituted or added to the listed items.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A piezoelectric actuator comprising:

a chamber diaphragm having a major surface; and a piezoelectric transducer positioned on the major surface of the chamber diaphragm, the piezoelectric transducer having a major surface with a first dimension that is smaller than a corresponding second dimension of the major surface of the chamber diaphragm, so that the piezoelectric transducer underlaps the chamber diaphragm, an underlap ratio of the first dimension to the second dimension ranging from about 0.70 to about 0.99.

2. The piezoelectric actuator of claim 1, wherein the underlap ratio ranges from about 0.8 to about 0.9.

3. The piezoelectric actuator of claim 1, wherein the underlap ratio is about 0.85.

4. The piezoelectric actuator of claim 1, wherein the chamber diaphragm comprises at least one material chosen from stainless steel, single crystal silicon, polysilicon, silicon nitride, silicon dioxide, nickel, aluminum, epoxy resin, polyimide and glass.

5. The piezoelectric actuator of claim 1, wherein the piezoelectric transducer comprises at least one material chosen from lead zirconium titanate, lead titanate, barium titanate, lead-magnesium-niobium-titanate, zinc-oxide, aluminum nitride, quartz, lithium tantalite, lithium niobate, and polyvinylidene fluoride.

6. The piezoelectric actuator of claim 1, wherein the chamber diaphragm comprises stainless steel and the piezoelectric transducer comprises lead zirconium titanate.

7. The piezoelectric actuator of claim 6, wherein a thickness of the piezoelectric transducer ranges from about 1 micron to about 100 microns.

8. The piezoelectric actuator of claim 1, wherein the major surface of the chamber diaphragm and the major surface of the piezoelectric transducer both have circular shapes, the first dimension being a diameter, $D_p$, of the piezoelectric transducer, and the second dimension being a diameter, $D_d$, of the chamber diaphragm.

9. The piezoelectric actuator of claim 1, wherein the major surface of the piezoelectric transducer has a length, $L_p$, and a width, $W_p$, and the major surface of the chamber diaphragm has a length, $L_d$, and a width, $W_d$, wherein underlap ratios of both $W_p$:$W_d$ and $L_p$:$L_d$ range from about 0.70 to about 0.99.

10. An inkjet printhead, comprising:

an ink chamber;

a chamber diaphragm having a major surface overlaying the ink chamber; and a piezoelectric transducer positioned on the major surface of the chamber diaphragm, the piezoelectric transducer having a major surface with a first dimension that is smaller than a corresponding second dimension of the major surface of the chamber diaphragm, so that the piezoelectric transducer underlaps the chamber diaphragm, an underlap ratio of the first dimension to the second dimension ranging from about 0.70 to about 0.99.

11. The piezoelectric actuator of claim 10, wherein the underlap ratio ranges from about 0.8 to about 0.9.

12. The piezoelectric actuator of claim 10, wherein the underlap ratio is about 0.85.

13. The piezoelectric actuator of claim 10, wherein the chamber diaphragm comprises at least one material chosen from stainless steel, single crystal silicon, polysilicon, silicon nitride, silicon dioxide, nickel, polyimide, aluminum, epoxy resin and glass.

14. The piezoelectric actuator of claim 10, wherein the piezoelectric transducer comprises at least one material chosen from lead zirconium titanate, lead titanate, barium titanate, lead-magnesium-niobium-titanate, zinc-oxide, aluminum nitride, quartz, lithium tantalite, lithium niobate, and polyvinylidene fluoride.

15. The piezoelectric actuator of claim 10, wherein the chamber diaphragm comprises stainless steel and the piezoelectric transducer comprises lead zirconium titanate.

16. The piezoelectric actuator of claim 10, wherein a thickness of the piezoelectric transducer ranges from about 1 micron to about 100 microns.

17. The piezoelectric actuator of claim 10, wherein the major surface of the chamber diaphragm and the major surface of the piezoelectric transducer both have circular shapes, the first dimension being a diameter, $D_p$, of the piezoelectric transducer, and the second dimension being a diameter, $D_d$, of the chamber diaphragm.

18. The piezoelectric actuator of claim 10, wherein the major surface of the piezoelectric transducer has a length, $L_p$, and a width, $W_p$, and the major surface of the chamber diaphragm has a length, $L_d$, and a width, $W_d$, wherein underlap ratios of both $W_p$:$W_d$ and $L_p$:$L_d$ range from about 0.70 to about 0.99.

* * * * *